US011106163B2

(12) United States Patent
Kawaguchi

(10) Patent No.: US 11,106,163 B2
(45) Date of Patent: Aug. 31, 2021

(54) FIXING DEVICE AND IMAGE FORMING APPARATUS

(71) Applicant: TOSHIBA TEC KABUSHIKI KAISHA, Tokyo (JP)

(72) Inventor: Takahiro Kawaguchi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/902,651

(22) Filed: Jun. 16, 2020

(65) Prior Publication Data

US 2021/0072676 A1 Mar. 11, 2021

(30) Foreign Application Priority Data

Sep. 5, 2019 (JP) ..... JP2019-162127

(51) Int. Cl.
*G03G 15/20* (2006.01)

(52) U.S. Cl.
CPC ..... *G03G 15/2025* (2013.01)

(58) Field of Classification Search
CPC ..... G03G 15/2025
See application file for complete search history.

(56) References Cited

U.S. PATENT DOCUMENTS 6,456,819 B1 * 9/2002 Abe ..... G03G 15/2064 219/216
2006/0018679 A1 * 1/2006 Ishino ..... G03G 21/206 399/94
2014/0119787 A1 * 5/2014 Hasegawa ..... G03G 15/2064 399/329
2017/0131664 A1 5/2017 Utsunomiya et al.
2018/0203384 A1 7/2018 Okamoto et al.

FOREIGN PATENT DOCUMENTS

JP 2017122840 A 7/2017

OTHER PUBLICATIONS

Extended European Search Report dated Jan. 29, 2021, mailed in counterpart European Application No. 20187131.6, 8 pages.

* cited by examiner

*Primary Examiner* — Sandra Brase
(74) *Attorney, Agent, or Firm* — Kim & Stewart LLP

(57) ABSTRACT

According to an embodiment, a fixing device used for fixing a toner image to a sheet in a printing process includes a rotatable heated body having an inner facing surface and an outer facing surface. A heater for heating the rotatable heated body has a length corresponding to the length of the heated body. A pressing member contacts the inner facing surface of the rotatable heated body at a first position. A pressing roller presses against the outer facing surface of the rotatable heated body at a position corresponding to the pressing member. A lubricant holding member has a lubricating surface that contacts the inner facing surface of the rotatable heated body at a second position. The lubricant holding member has a plurality of recesses in its lubricating surface. The recesses are spaced from each other along the length of the lubricant holding member.

18 Claims, 9 Drawing Sheets

FIXING DEVICE AND IMAGE FORMING APPARATUS

CROSS-REFERENCE TO RELATED APPLICATIONS

This application is based upon and claims the benefit of priority from Japanese Patent Application No. 2019-162127, filed on Sep. 5, 2019, the entire contents of which are incorporated herein by reference.

FIELD

The present disclosure generally relates to image forming apparatuses and fixing devices in image forming apparatuses.

BACKGROUND

An image forming apparatus, such as a multifunctional peripheral (MFP) or a laser printer, includes a fixing device used for fixing a toner image to a sheet. The fixing device transfers heat from a heater to the sheet working in conjunction with, for example, a fixing belt. Printing of an image, text or the like on the sheet is realized by fixing the toner image to sheet.

In fixing devices for this purpose, a pressing pad located on one side of the fixing belt presses against the fixing belt a position corresponding to a pressure roller to thereby form a nip between the fixing belt and the pressure roller. Therefore, when the fixing belt and the pressure roller rotate as the sheet passes through the nip, the inner peripheral surface of the fixing belt, against which the pressing pad presses, must slide while contacting the pressing pad. Therefore, a lubricant, such as silicone oil, is typically applied to the inner peripheral surface of the fixing belt. This reduces the frictional resistance of the fixing belt with respect to pressing pad.

However, it is known that such a lubricant (e.g., the silicone oil) may leak out from the edges of the fixing belt, or also may eventually evaporate with heating/use. As a result, the sliding performance of the fixing belt tends to gradually decrease. Therefore, there have been proposed various techniques for suppressing such deterioration in the performance of the fixing belt by supplying additional lubricant to the inner peripheral surface of the fixing belt even during the operation of the image forming apparatus.

In the conventional technique, since the additional lubricant is applied to the inner peripheral surface of the fixing belt by a lubricant supply member, it is possible to suppress the deterioration in the sliding performance of the fixing belt. However, when the lubricant is heated, its viscosity is concomitantly decreased, and this additional lubricant will more easily leak from the inner peripheral surface of the fixing belt. Therefore, when the operation time of the fixing device is extended in duration, the lubricant that is initially present may be insufficient. If a grease or the like having a high viscosity is used as a lubricant, it is possible to suppress this potential outflow of lubricant, but there is a problem with use of such a higher viscosity lubricant since such a material provides increased the viscous resistance and thus frictional resistance during operation is increased.

DETAILED DESCRIPTION

According to at least one embodiment, a fixing device for fixing a toner image to a sheet is provided. The fixing device includes a rotatable heated body with a length dimension in a first direction. The rotatable heated body has an inner facing surface and an outer facing surface. A heater is provided for heating the rotatable heated body. The heater has a length dimension in the first direction corresponding to the length dimension of the rotatable heated body. A pressing member contacts the inner facing surface of the rotatable heated body at a first position. A pressing roller presses against the outer facing surface of the rotatable heated body at a position corresponding to the pressing member. A lubricant holding member has a length dimension in the first direction and a lubricating surface contacting the inner facing surface of the rotatable heated body at a second position. The lubricant holding member has a plurality of recesses in the lubricating surface that are spaced from each other along the length dimension of the lubricant holding member.

Hereinafter, an image forming apparatus according to example embodiments will be described with reference to the accompanying drawings. In the description, an XYZ coordinate system consisting of an X-axis, a Y-axis, and a Z-axis orthogonal to each other is used as appropriate for the purposes of explanation.

Figure 1:
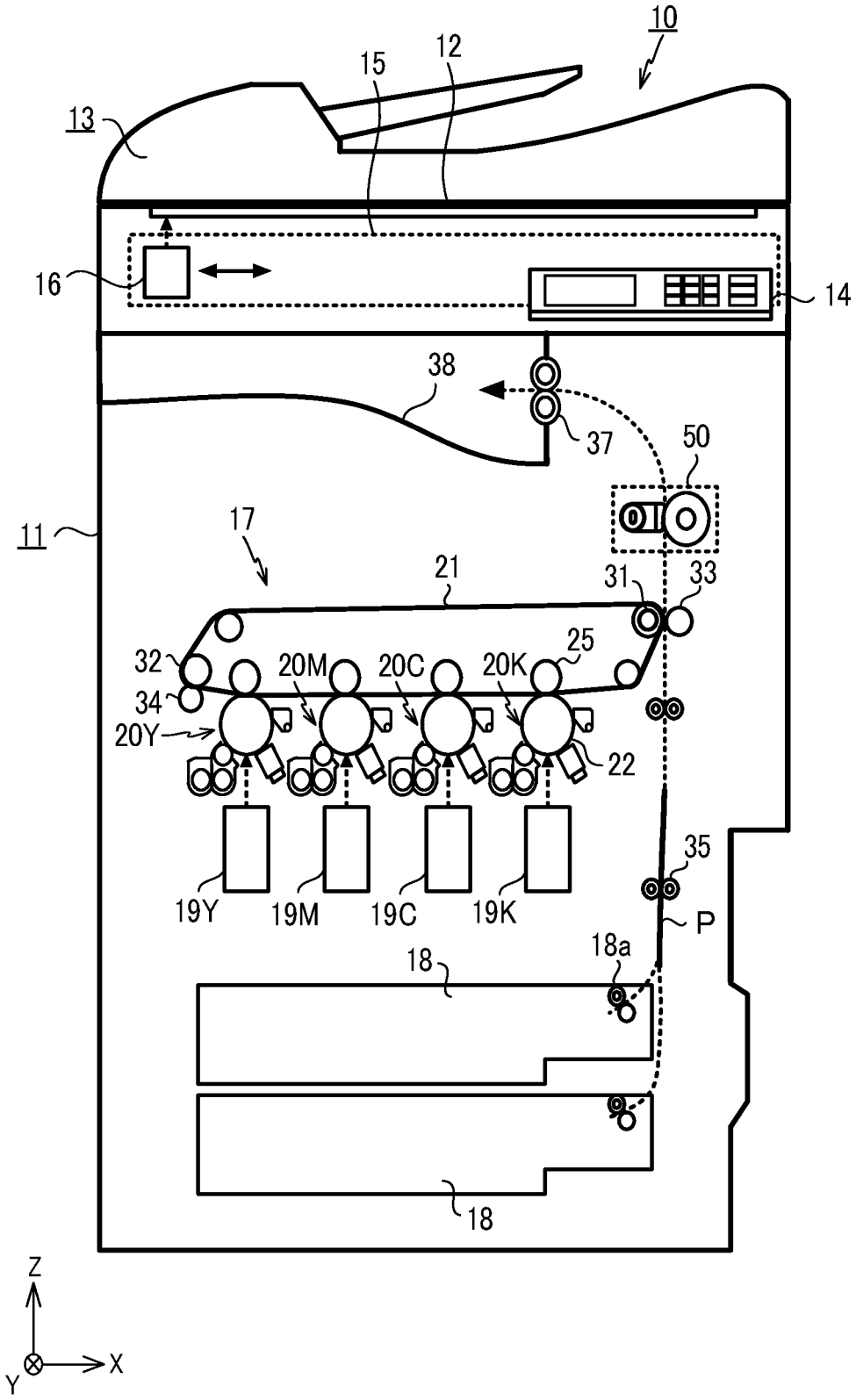
FIG. 1 is a diagram schematically depicting an image forming apparatus according to an embodiment.

FIG. 1 is a schematic diagram showing a configuration of an image forming apparatus 10 according to the present embodiment. The image forming apparatus 10 is, for example, a multi-function peripheral (MFP). The image forming apparatus 10 includes a main body 11 and an auto document feeder (ADF) 13 disposed above the main body 11. A platen 12 made of transparent glass is disposed on the top of the main body 11, and an auto document feeder (ADF) 13 is provided to cover the top surface of the platen 12. The ADF 13 is attached so as to be rotatable to cover and uncover the top surface of the platen 12. An operation panel 14 is provided on an upper portion of the main body 11. The operation panel 14 includes various keys, buttons, a graphical user interface (GUI), or the like.

A scanner 15 for reading a document is provided below the platen 12. The scanner 15 reads an original document fed by the auto document feeder 13 or an original document that has been manually placed on the platen 12 to generate image data. The scanner 15 includes an image sensor 16.

The image sensor 16 reads an image from the document while moving in the +X direction along the platen 12. The image sensor 16 is used when reading an image from a document that has been placed on the platen 12. Furthermore, when reading a document supplied by the auto document feeder 13, the image sensor 16 can be fixed to the position shown in FIG. 1, and the image data from the original document can be obtained as the document is fed past the fixed position by the ADF 13. The ADF 13 is capable of sending individual pages of a document sequentially past the fixed position for scanning each page of the document in turn.

An image forming section 17 is arranged inside the main body 11. The image forming section 17 forms a toner image on a recording medium, such as sheet of paper fed from a sheet cassette 18, based on image data read by the scanner 15 and image data generated by a personal computer or the like.

The image forming section 17 includes image forming sections 20Y, 20M, 20C, and 20K for forming latent images using toners of the respective colors yellow (Y), magenta (M), cyan (C), and black (K). Scanning heads 19Y, 19M, 19C, and 19K are provided corresponding to of the image forming sections 20Y, 20M, 20C, and 20K. The image forming section 17 in this embodiment includes an intermediate transfer belt 21.

The image forming sections 20Y, 20M, 20C, and 20K are disposed below the intermediate transfer belt 21. In image forming section 17, image forming sections 20Y, 20M, 20C, and 20K are arranged from the −X side to the +X side. Scanning heads 19Y, 19M, 19C, and 19K are disposed under image forming sections 20Y, 20M, 20C, and 20K, respectively.

Figure 2:
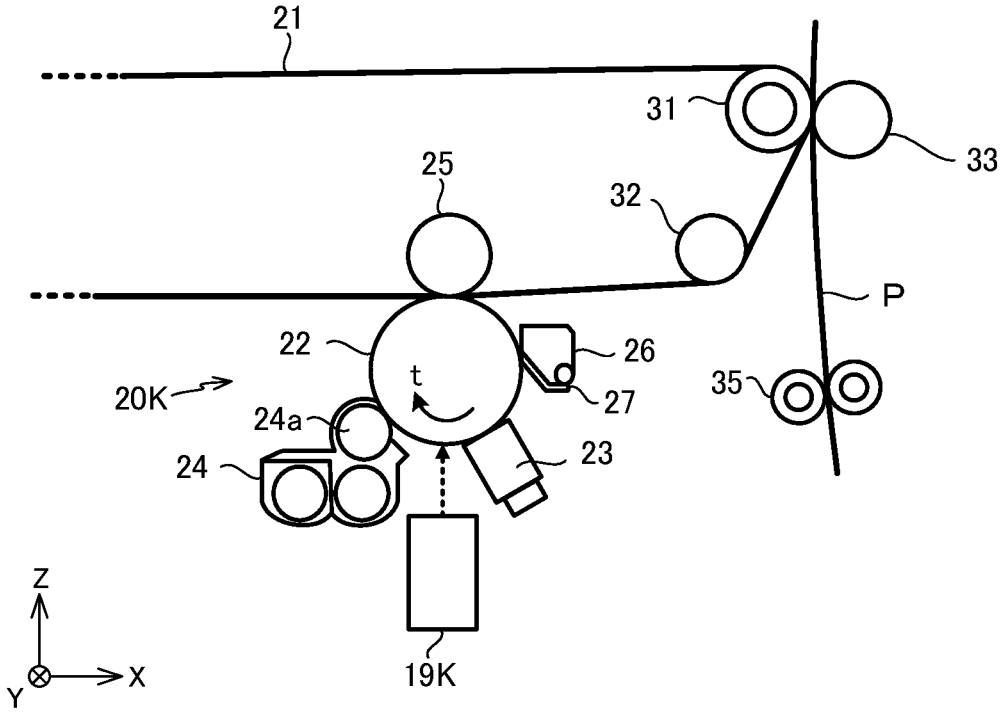
FIG. 2 is an enlarged view of an image forming section.

FIG. 2 is an enlarged view of image forming section 20K. The image forming sections 20Y, 20M, 20C, and 20K are substantially similar to each other, but for toner color. That is, each image forming section 20Y, 20M, 20C, and 20K has an equivalent configuration. For this reason, the configuration of each image forming section will be described by taking the image forming section 20K as an example.

Image forming section 20K has a photosensitive drum 22. A charger 23, a developing device 24, a primary transfer roller 25, a cleaner 26, and the like are disposed around the photosensitive drum 22 in the state order along the direction indicated by the arrow t. The photosensitive drum 22 is irradiated with laser light from the scanning head 19K at an exposure position. When the surface of the rotating photosensitive drum 22 is irradiated with laser light, an electrostatic latent image is formed on the surface of the photosensitive drum 22.

The charger 23 in the image forming section 20K uniformly charges the surface of the photosensitive drum 22. The developing device 24 supplies toner to the photosensitive drum 22 via the developing roller 24*a* to which the developing bias is applied, thereby developing the electrostatic latent image. The cleaner 26 separates and removes residual toner left on the surfaces of photo sensitive drum 22 by using the blade 27. The toner separated by the blade 27 is collected in the cleaner 26.

As shown in FIG. 1, the intermediate transfer belt 21 is stretched around a drive roller 31 and three driven rollers 32. The intermediate transfer belt 21 rotates counterclockwise in FIG. 1 by the rotation of the drive roller 31. As shown in FIG. 1, the intermediate transfer belt 21 is in contact with the upper surfaces of photosensitive drums 22 in each of image forming section 20Y, 20M, 20C, and 20K. A primary transfer roller 25 is applied with a primary transfer bias at a position of the intermediate transfer belt 21 opposed to the photosensitive drum 22. Thus, the toner image developed on the surface of the photosensitive drum 22 is transferred to the intermediate transfer belt 21 (referred to as a primary transfer).

A secondary transfer roller 33 is disposed opposite to the drive roller 31 that can be used for stretching/tensioning the intermediate transfer belt 21. When the sheet P passes between the drive roller 31 and the secondary transfer roller 33, the secondary transfer roller 33 applies a secondary transfer bias to the sheet P. Thus, the toner image formed on the intermediate transfer belt 21 is transferred onto the sheet P (referred to as a secondary transfer). As shown in FIG. 1, a belt cleaner 34 is provided in the vicinity of the driven roller 32 for the intermediate transfer belt 21. The residual toner left on the surface of the intermediate transfer belt 21 is removed by the belt cleaner 34.

As shown in FIG. 1, a sheet feed roller 35 is provided on the sheet conveyance path between the sheet cassettes 18 and the secondary transfer roller 33. Each sheet P is taken out from the sheet cassette 18 by a pickup roller 18*a* disposed near the sheet cassette 18. The sheet P is conveyed to the intermediate transfer belt 21 and the secondary transfer roller 33 by a sheet feed roller 35. Multiple sheet feed rollers 35 may be provided as appropriate and pairs of sheet feed rollers 35 may be utilized for sheet conveyance.

A fixing device 50 is provided above the secondary transfer roller 33. A sheet discharge roller 37 is provided above the fixing device 50. The sheet P that has been passed through the intermediate transfer belt 21 and the secondary transfer roller 33 is heated by the fixing device 50. Thus, the toner image is fixed to the sheet P by heat. The sheet P that has passed through the fixing device 50 is then discharged to the sheet discharge unit 38 (e.g., a discharge tray) by the sheet discharge roller 37.

Figure 3:
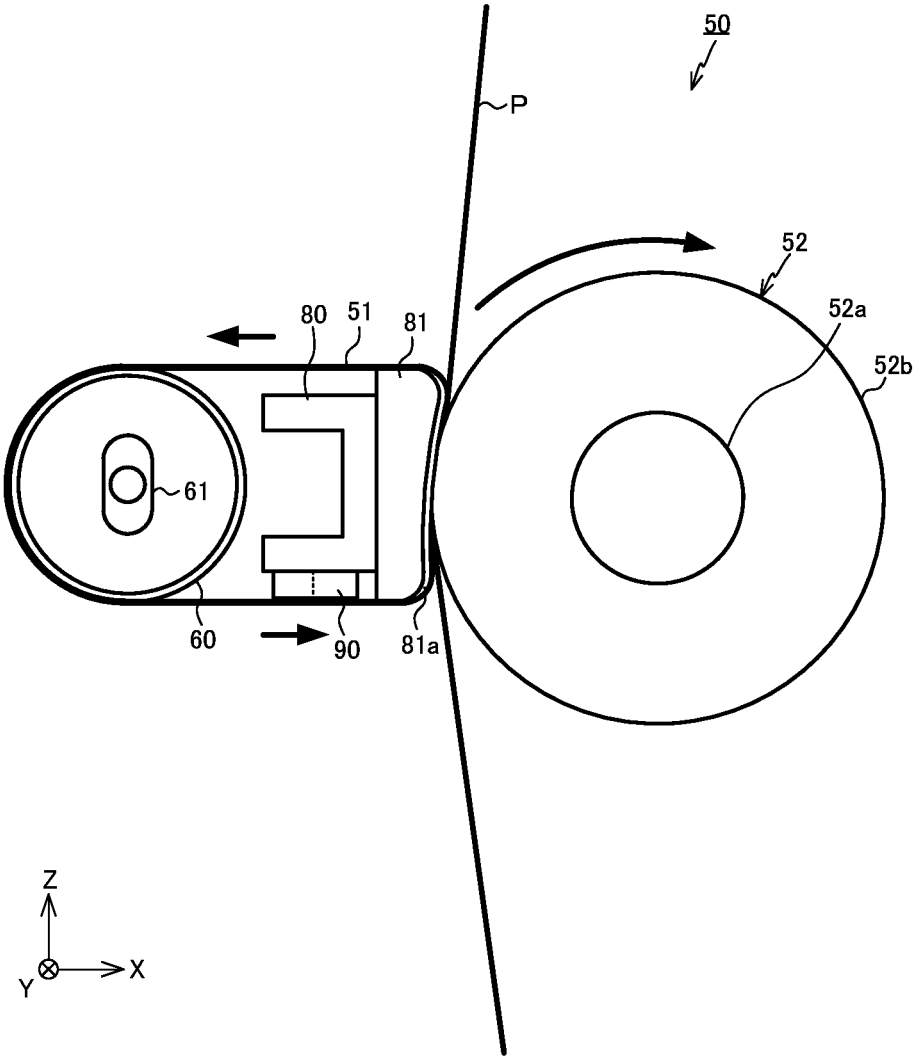
FIG. 3 depicts an example of a fixing device.

FIG. 3 depicts an example of the fixing device 50. The fixing device 50 includes a pressing roller 60, a base member 80, a pressing pad 81 supported by the base member 80, a fixing belt 51, a pressure roller 52, and a lubricant holding member 90 and the like.

Figure 4:
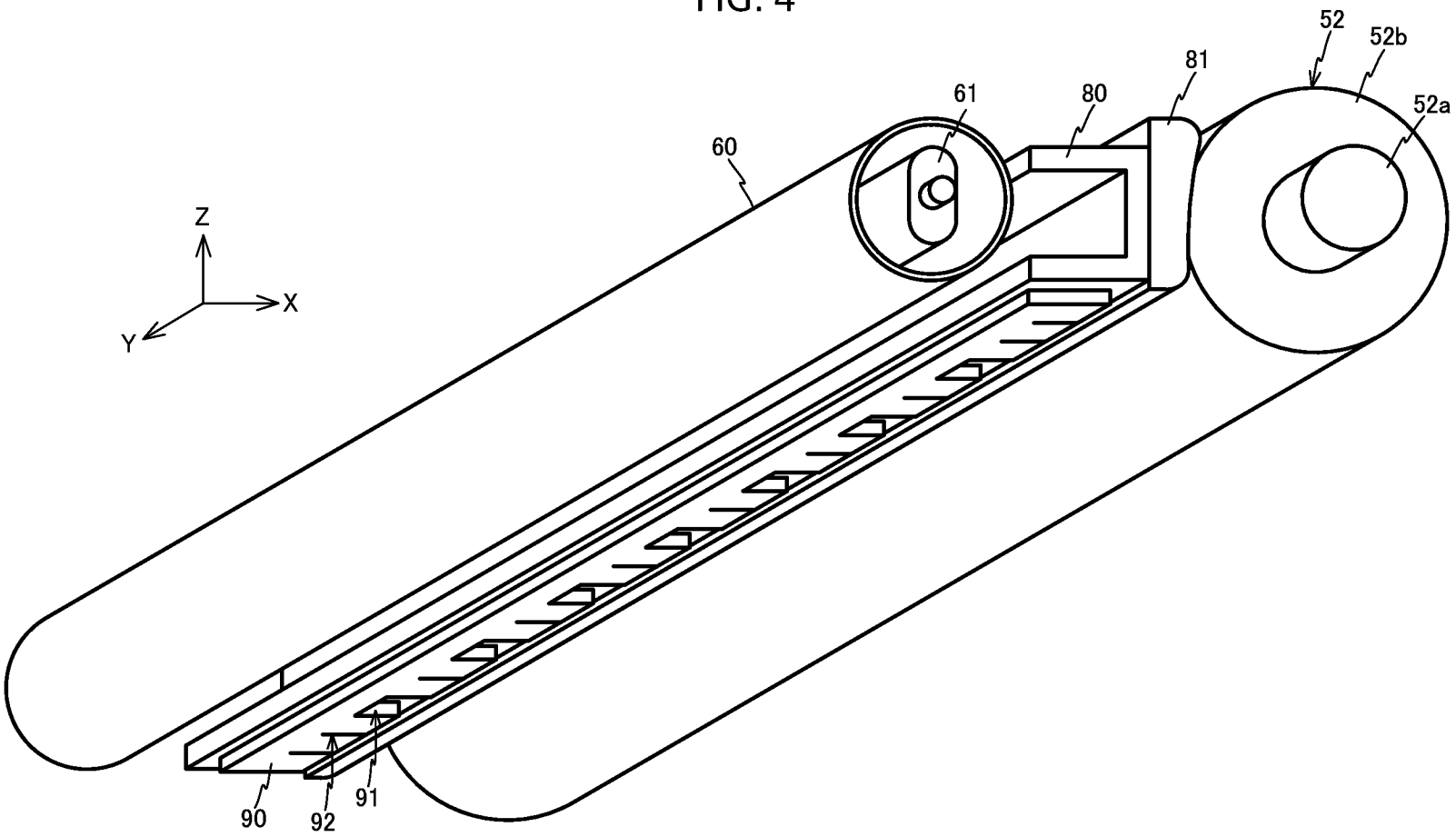
FIG. 4 is a perspective view depicting a fixing device with the fixing belt omitted.

FIG. 4 is a perspective view of the fixing device 50 shown in FIG. 3, with the fixing belt 51 omitted for purposes of explanation. The heating roller 60 is a cylindrical member having a longitudinal direction as the Y-axis direction. The heating roller 60 has a length of about 35 cm, a diameter of about 20 mm, and is made of a metal having a high thermal conductivity such as aluminum, for example. The heating roller 60 is supported so as to be rotatable about an axis parallel to the Y-axis. A heater 61, for example, is disposed inside the heating roller 60. The heater 61 has substantially the same length in the Y-axis direction as that of heating roller 60. The heater 61 is for example a halogen lamp.

The base member 80 is long in the Y-axis direction and has U-shaped cross section in the XZ plane. The base member 80 is made of, for example, iron, stainless steel, or the like. The base member 80 is substantially equal in length to the heating roller 60 and is supported horizontally so as to be parallel to the Y-axis.

The pressing pad 81 is similarly long in direction of the Y-axis direction. Pressing pad 81 has a length substantially equal to that of the length of the heating roller 60. The material of the pressing pad 81 is, for example, a silicone rubber, a fluorine rubber or other elastic material, or a polyimide resin, polyphenylene sulfone resin (PPS), polyether sulfone (PES), a liquid crystal polymer (LCP), or a heat-resistant resin such as a phenol resin (PF). For example, as shown in FIG. 3, a sliding sheet 81*a* having low frictional resistance may be provided at the surface of the pressing pad 81 to cover outward facing surface of the pressing pad 81. As the sliding sheet 81*a*, for example, a glass cloth impregnated with a fluorine resin can be used.

The fixing belt 51 is an annular belt formed into a cylindrical shape having a longitudinal direction in the Y-axis direction. The length of the fixing belt 51 in the Y-axis direction is substantially equal to the length of the heating roller 60, and is greater than the width (the dimension in the Y-axis direction) of the sheet P. The fixing belt 51 is wound around a heating roller 60 and a pressing pad 81. The fixing belt 51 is stretched with a constant tension when pressed in the −X direction by the heating roller 60.

Fixing belt 51 has a thickness of about 300 μm. The fixing belt 51 is made of, for example, a polyimide film having a high heat resistance and a thickness of 70 μm as a base material. A metal layer, a composite functional layer, an elastic layer, and a protective layer are laminated on the surface of this base material.

The metal layer is a layer made of a metal such as copper or stainless steel (SUS), and the composite functional layer is a layer made of nickel. The elastic layer is a layer made of silicone rubber having a thickness of about 200 μm. The elastic layer can be covered with a protective layer made of a PFA resin (perfluoroalkoxy polymeric resin) or the like. The elastic layer and the protective layer are adjusted in thickness so that the heat capacity does not become too large in order to shorten the warm-up time of fixing device 50. A silicone oil is applied as a lubricant to the inner peripheral surface of the fixing belt 51.

As shown in FIG. 4, the pressure roller 52 is a cylindrical member having a longitudinal direction in the Y-axis direction. The pressure roller 52 includes a core member 52*a* made of a metal such as aluminum, and a silicone rubber layer 52*b* laminated on an outer peripheral surface of the core member 52*a*. The surface of the silicone rubber layer 52*b* is coated with a PFA resin (perfluoroalkoxy polymeric resin). The pressure roller 52 has an outer diameter of, for example, about 30 mm and a length substantially equal to the width of the fixing belt 51.

The pressure roller 52 is supported so as to be rotatable about the core member 52*a*, and is biased in the −X direction by, for example, elastic force of a spring. As a result, pressure roller 52 rests against pressing pad 81 with the fixing belt 51 interposed therebetween. The pressure roller 52 presses against the pressing pad 81, via the fixing belt 51, so as to form a nip between the pressure roller 52 and the fixing belt 51.

The lubricant holding member 90 is made of a material that has a property of high liquid absorbency or retention properties and can be elastically deformed. The lubricant holding member 90 is adhered to a lower surface of the base member 80 (a surface on the −Z side) by an adhesive, for example. The lubricant holding member 90 has a longitudinal direction along the Y-axis direction, and a length in the Y-axis direction that is equal to the length of the fixing belt 51. The width of the lubricant holding member 90 (the dimension in the X-axis direction) is, for example, about 1 cm to about 2 cm, and the thickness thereof is about 3 mm to about 5 mm, for example. The lubricant holding member 90 is made of, for example, a material having high liquid absorbency and high heat resistance, such as aramid fiber, melamine resin, glass fiber, and the like.

A rectangular recess 91 and slit 92 are formed from the outer edge on the +X side extending along the X direction towards the center portion of the lubricant holding member 90. Except for the slits 92 formed at both ends in the Y-axis direction of the lubricant holding member 90, the recesses 91 and the slits are alternately formed with each other along the Y-axis direction.

Figure 5:
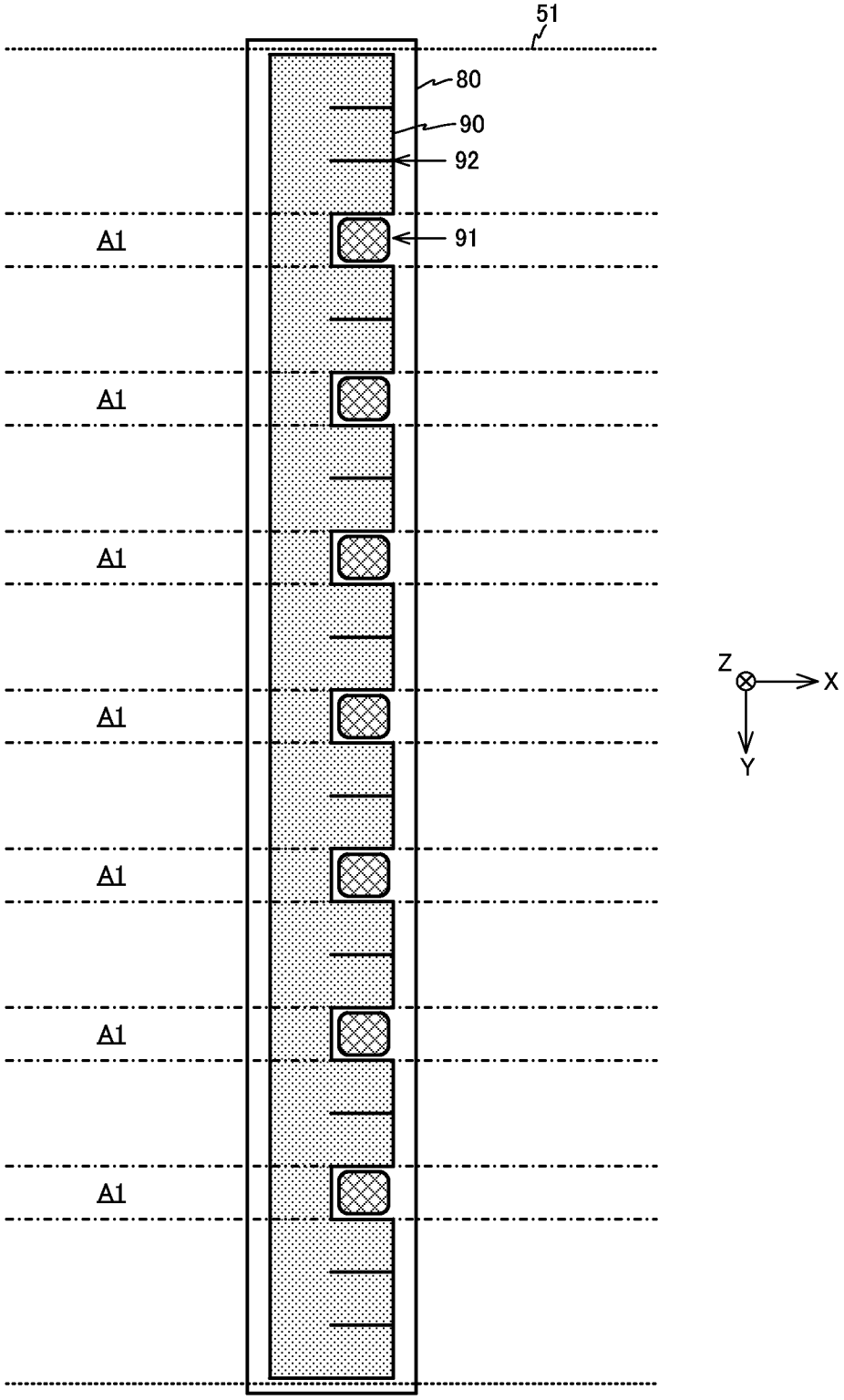
FIG. 5 is a plan view of a lubricant holding member attached to a base member.

FIG. 5 is a plan view of a lubricant holding member 90 attached to a base member 80. As depicted in FIG. 5, the shaded portion of the lubricant holding member 90 indicates portions of the lubricant holding member 90 that have been impregnated with an oil as a first lubricant, and the hatched portions in FIG. 5 indicate that a grease as a second lubricant has been added to the inside of the recess 91. The second lubricant in the recess 91 is retained (restricted in movement) by the lubricant holding member 90.

As the first lubricant, silicone oil having a viscosity of about 100 centistokes (cSt) at 100° C. can be used. As the second lubricant, a lubricant having a viscosity of about 200 cSt to 300 cSt (at 100° C.), such as a grease having a synthetic oil as a base oil, can be used.

As shown in FIG. 3, the lubricant holding member 90 is attached to the bottom surface (−Z side) of the base member 80, so that it comes into contact with the inner peripheral surface of the fixing belt 51. In this state, the lubricant holding member 90 will be elastically deformed, and the surface abutting the fixing belt 51 will pressed against the fixing belt 51 by the elastic response of the lubricant holding member 90.

In the fixing device 50, the heating roller 60 is heated by energy from the heater 61. The heating roller 60 heats the fixing belt 51 to raise the temperature of the fixing belt 51 to the appropriate fixing temperature. By rotating the pressure roller 52, the sheet P is conveyed through the nip between the pressure roller 52 and the fixing belt 51. As a result, the sheet P is heated by the heated fixing belt 51, and the toner image formed on the sheet P is fixed to the sheet P.

As the fixing belt 51 rotates, the first lubricant impregnated in the lubricant holding member 90 is applied to the entire inner peripheral surface of the fixing belt 51. The second lubricant added to the recess 91 is applied only to the area(s) A1 (see FIG. 5) on the inner peripheral surface of the fixing belt 51 which correspond to the recesses 91.

Figure 6:
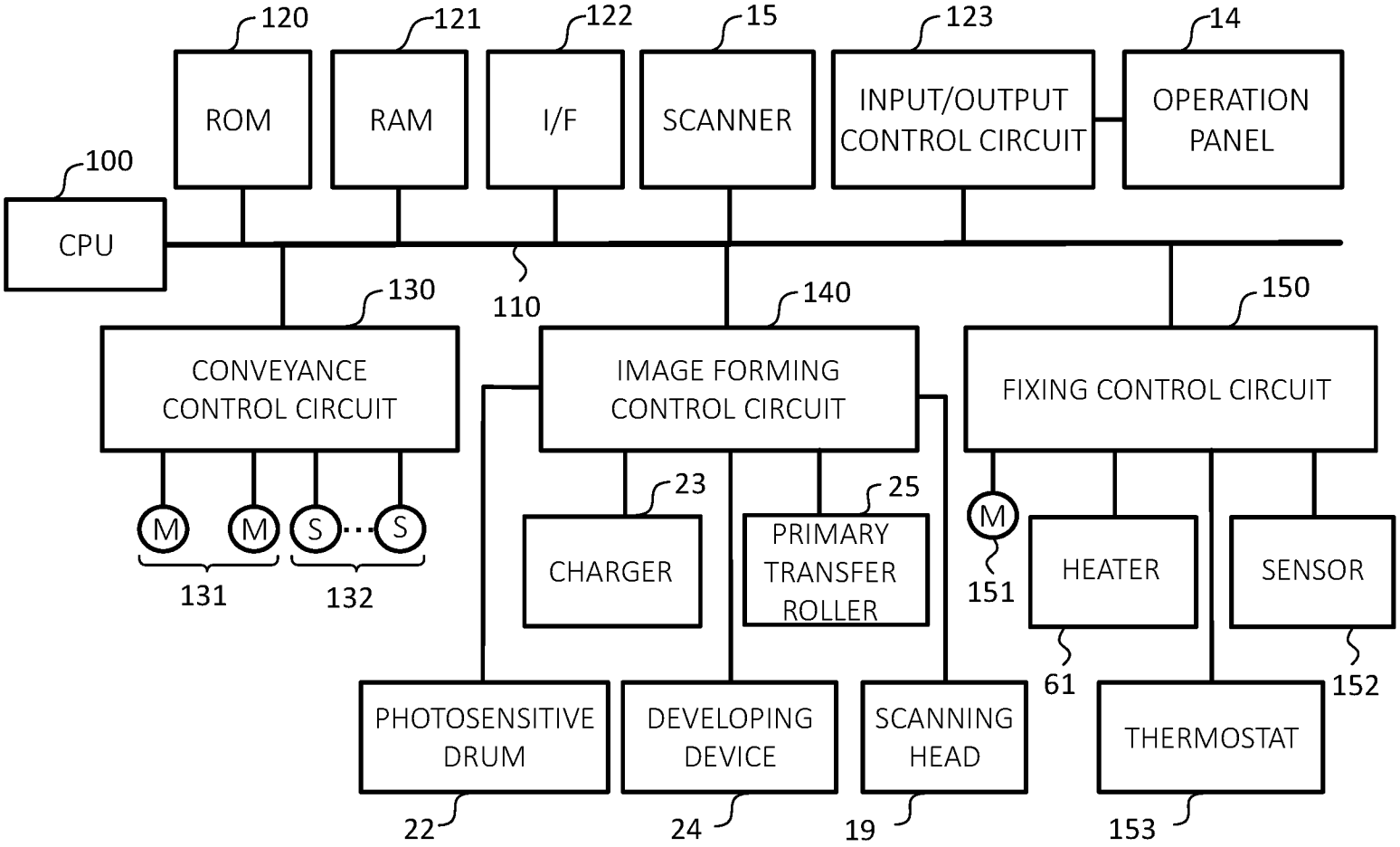
FIG. 6 is a block diagram of an image forming apparatus.

FIG. 6 is a block diagram of the image forming apparatus 10. A central processing unit (CPU) 100 for controlling the entire image forming apparatus is provided, along with a bus line 110, a read only memory (ROM) 120, a random access memory (RAM) 121, an interface (I/F) 122, a scanner 15, an input/output control circuit 123, a conveyance control circuit 130, an image forming control circuit 140, and a fixing control circuit 150. The CPU 100 and the various other circuits and components are connected to each other via a bus line 110.

The ROM 120 stores control programs and control data for specifying the basic operations of the image forming process.

The RAM 121 functions as a working memory serving as a working area of the CPU 100.

The CPU 100 executes a program stored in the ROM 120, for example. Accordingly, the various components of the image forming apparatus 10 are controlled by the CPU 100, and the processing associated with forming an image on the sheet are sequentially executed.

The interface 122 communicates with an apparatus such as a user terminal, such as a personal computer or the like. The input/output control circuit 123 functions to display information on the operation panel 14 for the user and accepts user input from the operation panel 14. The user of the image forming apparatus 10 can designate, for example, the sheet size, the number of copies of the document, and the like by operating the operation panel 14.

The conveyance control circuit 130 is a unit for controlling a motor group 131 for driving the pickup roller 18*a*, the sheet feed roller 35, the sheet discharge roller 37, and the like. The conveyance control circuit 130 controls the motor group 131 in accordance with a control signal from the CPU 100 or the detection results of various sensors 132 provided along the sheet conveyance path, the vicinity of the sheet cassette 18, or the like.

The image forming control circuit 140 controls the photosensitive drum 22, the charger 23, the scanning heads 19Y, 19M, 19C, 19K, the developing device 24, and the primary transfer roller 25 based on the control signal from the CPU 100.

The fixing control circuit 150 controls the driving motor 151 for rotating the pressure roller 52 of the fixing device 50 based on the control signal from the CPU 100, and drives the heater 61 based on the output from the sensor 152 provided for detecting the temperature of the fixing belt 51, the size of the sheet P notified from the CPU 100, or the like. The fixing control circuit 150 also stops the operation of the fixing device 50 based on a signal from the thermostat 153 that monitors for overheating of the fixing belt 51.

In the image forming apparatus 10, an image forming process for performing printing on the sheet P is performed by using a print command from a user as a trigger. The image forming process is performed, for example, when image data received via the interface 122 is instructed to be printed, or when image data generated by the scanner 15 is to be printed.

The image forming process of the image forming apparatus 10 will now be described. When the image forming apparatus 10 receives a print command from the user, the image forming apparatus 1 executes an image forming process for forming an image on the sheet P. In the image forming process, as shown in FIG. 1, the sheet P is drawn from a sheet cassette 18 by the pickup roller 18*a*, and is conveyed between the intermediate transfer belt 21 and the secondary transfer roller 33 by the sheet feed roller 35.

In parallel with the above operation, toner images are formed on the respective photosensitive drums 22 in the image forming sections 20Y, 20M, 20C, and 20K. The toner images formed on photosensitive drum 22 in each image forming section 20Y, 20M, 20C, and 20K are sequentially transferred to intermediate transfer belt 21. As a result, a composite toner image composed of yellow (Y) toner, magenta (M) toner, cyan (C) toner, and black (K) toner is formed on the intermediate transfer belt 21.

When the sheet P passes through the nip formed between intermediate transfer belt 21 and the secondary transfer roller 33, the toner image formed on the intermediate transfer belt 21 is transferred to the sheet P. As a result, a toner image composed of yellow (Y), magenta (M), cyan (C), and black (K) toners is on the sheet P.

The sheet P then passes through the fixing device 50. During this time, the fixing control circuit 150 controls the output of the heater 61 in accordance with the size of the sheet P. The sheet P is heated by passing through the fixing device 50. Thus, the toner image previously transferred to the sheet P is fixed to the sheet P, and an image is printed on the sheet P. The sheet P is then discharged to the sheet discharge unit 38 by the sheet discharge roller 37. In the image forming process, the above-described processing can be executed in accordance with the number of copies or sheets to be printed.

As described above, in the fixing device 50, as shown in FIG. 5, oil having a low viscosity is impregnated in the lubricant holding member 90 and a higher viscosity grease is added to the recesses 91 of the lubricant holding member 90. Thus, a first lubricant having a lower viscosity can be applied to the entire inner peripheral surface of the fixing belt 51, and a second lubricant having a higher viscosity is applied only to regions A1 on the inner peripheral surface of the fixing belt 51. The regions A1 correspond in position to the positions of the recesses 91.

Therefore, movement of the first lubricant along the Y-axis direction toward an outer edge portion of the fixing belt 51 is reduced after being applied to the inner peripheral surface of the fixing belt 51 by the presence of the higher viscosity second lubricant also on the inner peripheral surface of the fixing belt 51. Accordingly, it is possible to suppress the outflow of the first lubricant from the fixing belt 51. As a result, the friction between the fixing belt 51 and pressing pad can be kept low for a long period without significantly increasing the viscous resistance. In addition, when a cushioning material such as a sliding sheet 81*a* is provided between the pressing pad 81 and the fixing belt 51, the friction between the cushioning member and the fixing belt 51 can be kept low for a long period.

Accordingly, wear on the various contacting materials such as fixing belt 51 and pressing pad 81 or fixing belt 51 and sliding sheet 81*a* can be suppressed, and the performance of fixing device 50 can be maintained for a long period.

When the fixing device is assembled, a significant amount of lubricant, such as silicone oil, is typically applied to the inner peripheral surface of the fixing belt. However, due to the rotation and use of the fixing belt, the lubricant flows out beyond the edges of the fixing belt and eventually the amount of remaining lubricant becomes insufficient to reduce friction and wear. As a result, the sliding performance between the fixing belt and the pressing pad will be reduced. Even if the amount of lubricant applied at the time of assembling the fixing device is increased, the amount of lubricant flowing out during of operation or assembly of the apparatus will generally be increased as well, so that any effect of increasing the amount of lubricant applied at device assembly is relatively limited. In a fixing device according to the present disclosure, lubricant can be continuously supplied during operation, so that the lubrication of the fixing belt can be maintained over a long period.

In addition, in the fixing device 50, the recesses 91 and the slits 92 are alternately provided on the lubricant holding member 90. By providing a slit 92, movement of the second lubricant which is added in the recess 91, is suppressed in the direction along the Y-axis. Therefore, the first lubricant and the second lubricant can be held in a separated state on lubricant holding member 90. Accordingly, it is possible to effectively suppress the outflow of the first lubricant by use of the second lubricant applied to the fixing belt 51. Therefore, abrasion wear due to the movement of the fixing belt 51 can be suppressed, and the performance of the fixing device 50 can be maintained for a long time.

In addition, with fixing device 50, even when the first lubricant flows out, the second lubricant does not flow out, but instead remains on the inner peripheral surface of the fixing belt 51. Therefore, it is possible to maintain the sliding property of fixing belt 51 for a long period.

Since an image forming apparatus 10 according to the present embodiment includes a fixing device 50 as described, it is possible to form an image in such an apparatus with high throughput (a large number of sheets can be printed in a substantially continuous process without deterioration or maintence).

Figure 7:
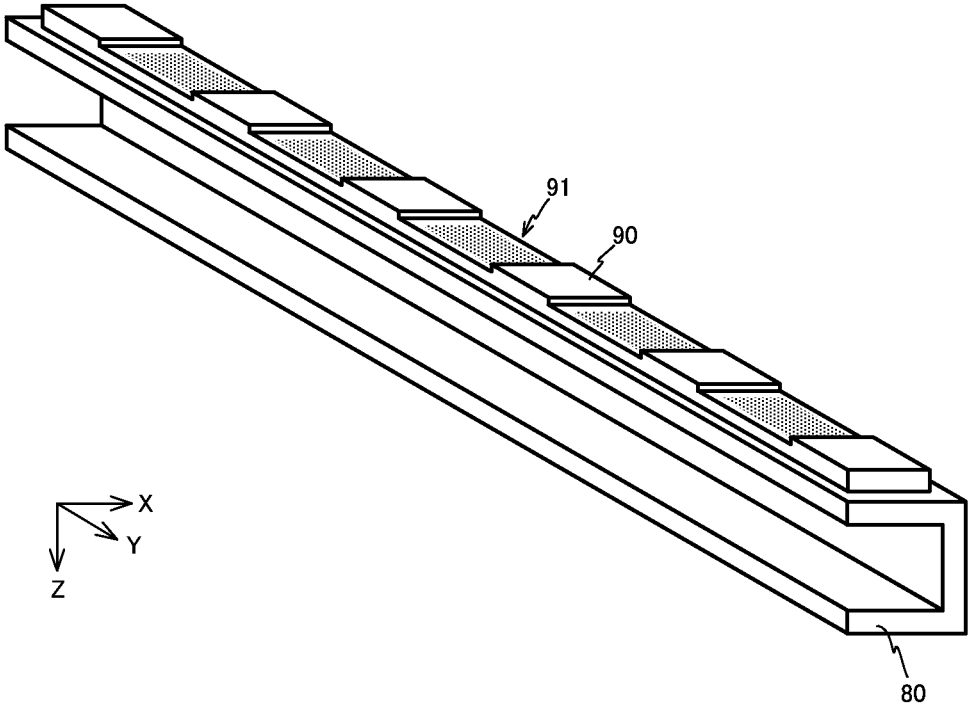
FIG. 7 is a perspective view depicting a lubricant holding member according to a modified example.

The present disclosure is not limited to the example embodiments described above. For example, FIG. 4, depicts a lubricant holding member 90 formed with the recess 91 extending from the +X side outer edge to the center portion. However, the shape of the recess 91 provided in the lubricant holding member 90 is not limited thereto. For example, as shown in FIG. 7, a recess 91 may be formed from a contact surface (a surface on the −Z side) of the lubricant holding member 90 to a center portion of the lubricant holding member 90. In this case, a second lubricant having a high viscosity can be added to the bottom surface of the recess 91 as depicted by the shaded state in FIG. 7.

In this case as well, a first lubricant having a low viscosity resistance is applied to the entire region of the inner peripheral surface of the fixing belt 51, and the second lubricant having a high viscosity is selectively applied to the annular region A1 of the inner peripheral surface of the fixing belt 51 which passes through the recess 91. Accordingly, the leakage of the first lubricant is suppressed, so that the wear due to the sliding of the fixing belt 51 is suppressed, and the performance of the fixing device 50 can be maintained for a long time.

Figure 8:
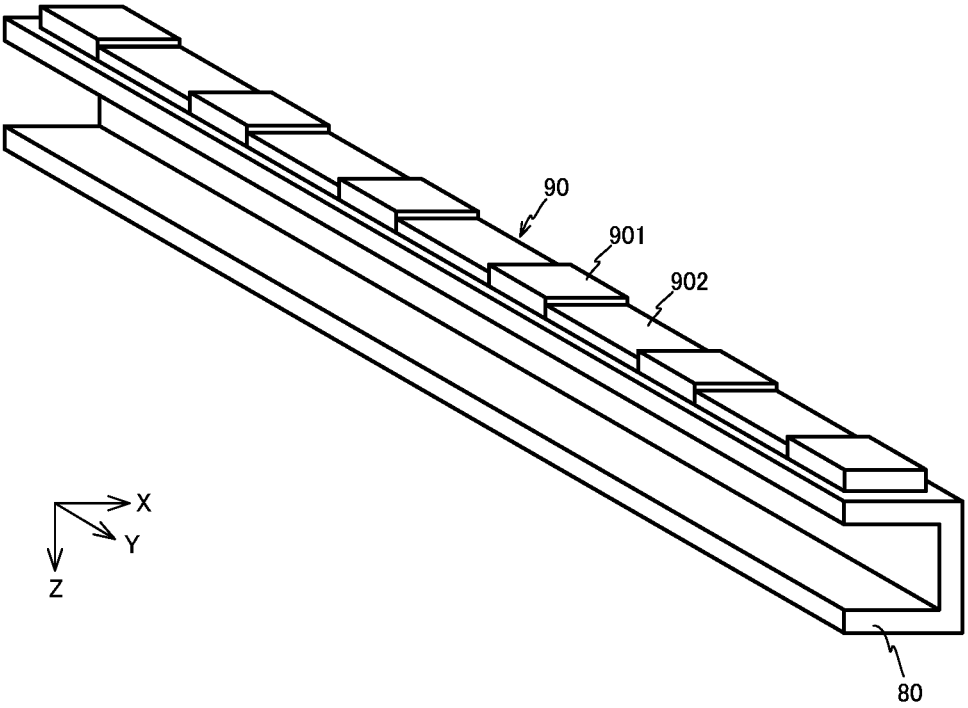
FIG. 8 is a perspective view depicting a lubricant holding member according to a modified example.

As shown in FIG. 8, when a recess 91 is formed on the contact surface of the lubricant holding member 90, lubricant holding members 901 and 902 having the same dimension in the X-axis direction, but different height in the Z-axis direction, can be considered to be formed. As shown in FIG. 8, such lubricant holding members 901 and 902 may be repeatedly disposed along the Y-axis in alternation. In this case, the penetration (flow) of the lubricant along the Y-axis direction is suppressed at the boundary between each of the lubricant holding members 901 and 902. Therefore, the first lubricant and the second lubricant can be separated from each other by the lubricant holding member 90. Accordingly, it is possible to effectively suppress the outflow of the first lubricant with the second lubricant applied to the fixing belt 51.

Further, the relative size of lubricant holding members 902 (to which the first lubricant having a low viscosity is added) may be increased to reduce the relative coverage of the lubricant holding members 901 (to which the second lubricant having a high viscosity is added) on the lubricant holding member 90. As a result, two kinds of lubricants can be efficiently held.

In one embodiment depicted in FIG. 5, the lubricant holding member 90 is formed with a total of seven recesses 91. However, this is not a limitation and the lubricant holding member 90 may be formed with six or less, or eight or more recesses 91.

In consideration of the fact that the lubricant flows out from both edges of the fixing belt 51 to the outside, it is also possible to arrange recesses 91 more densely proximate to the ends in the Y-axis direction of the lubricant holding member 90. That is, spacing between adjacent recesses 91 may be closer near the ends of the lubricant holding member 90. Furthermore, the dimension of the recesses 91 in the Y-axis direction may be increased for those recesses 91 nearer to the ends of the lubricant holding member 90 in the Y-axis direction relative those nearer the center.

In the above description, the first lubricant was referred to as an oil and the second lubricant was referred to as a grease. However, the first lubricant is not specifically limited to oils, and may be a grease (or referred to as being a grease) as long as its viscosity is 100 cSt or so. Similarly, the second lubricant may be a lubricant other than a grease. In general, the second lubricant can be an oil (or referred to as being an oil), as long as it has a viscosity greater than that of the first lubricant.

In the above-described example embodiment, a halogen type heater 61 is used as a heat source for heating the fixing belt 51. However, in other examples, the fixing belt 51 may be heated by using electromagnetic induction or the like by means of a heating coil or the like. Furthermore, in still other examples, the fixing belt 51 may be heated by using a ceramic heater or the like.

Figure 9:
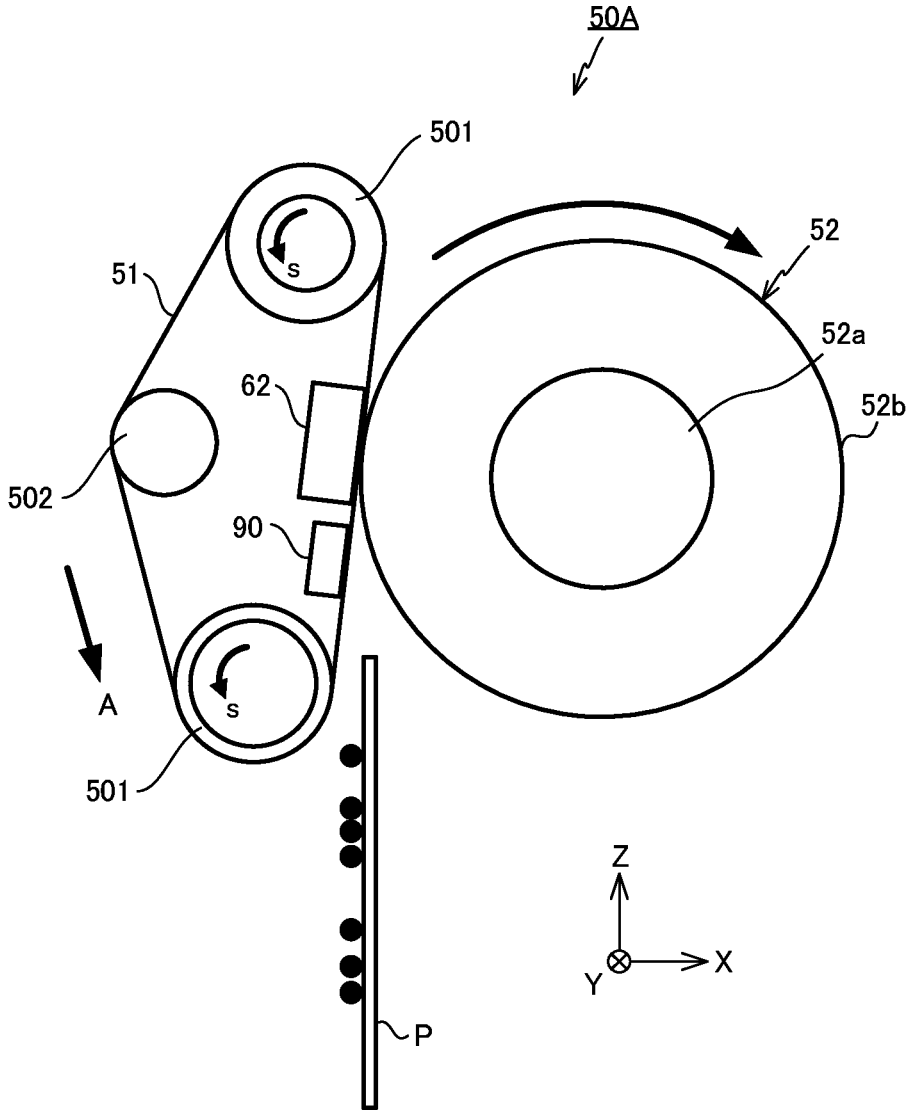
FIG. 9 is a diagram illustrating a fixing device according to a modification example.

For example, FIG. 9 shows a ceramic heater 62 being used as a heat source in fixing device 50A. As shown in FIG. 9, in fixing device 50A, fixing belt 51 is stretched over a pair of drive rollers 501 for rotating the fixing belt 51, and tensioning roller 502 for tensioning the fixing belt 51. The fixing belt 51 rotates in the direction shown by arrow A by rotations of the drive rollers 501 in the direction indicated by arrow s. The ceramic heater 62 comprises, for example, a substrate made of ceramic and a heating portion formed of a resistance element formed on the substrate. The heating portion is in contact with the inner peripheral surface of the fixing belt 51.

In fixing device 50A, the pressure roller 52 is pressed against the heating portion of the ceramic heater 62 contacting the inner peripheral surface of the fixing belt 51, whereby a nip is formed between the fixing belt 51 and the pressure roller 52. The sheet P to which the toner image has already been transferred passes through the nip, and is thereby heated. As a result, the toner image is fixed to the sheet P, and an image is formed on the sheet P.

In the above-described example embodiment, the case in which the image forming apparatus 10 is a multifunction peripheral has been described. However, the image forming apparatus 10 is not limited to this and may be a laser printer or the like.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed:

1. A fixing device for fixing a toner image to a sheet, the fixing device comprising:

a rotatable heated body with a length dimension in a first direction and having an inner facing surface and an outer facing surface;

a heater for heating the rotatable heated body, the heater having a length dimension in the first direction corresponding to the length dimension of the rotatable heated body;

a pressing member contacting the inner facing surface of the rotatable heated body at a first position;

a pressing roller configured to press against the outer facing surface of the rotatable heated body at a position corresponding to the pressing member;

a lubricant holding member with a length dimension in the first direction and a lubricating surface contacting the inner facing surface of the rotatable heated body at a second position, the lubricant holding member having a plurality of recesses in the lubricating surface spaced from each other along the length dimension of the lubricant holding member;

a first lubricant of a first viscosity applied to the lubricating surface of the lubricant holding member; and a second lubricant of a second viscosity greater than the first viscosity in the plurality of recesses.

2. The fixing device according to claim 1, wherein the rotatable heated body is a fixing belt.

3. The fixing device according to claim 1, wherein the lubricating holding member has a plurality of slits formed in the lubricating contact surface between adjacent recesses of the plurality of recesses.

4. The fixing device according to claim 3, wherein the slits of the plurality slits extend in a second direction perpendicular to the first direction from an outer edge of the lubricating contact surface for a total distance that is less than a width of the lubricant contacting surface in the second direction.

5. The fixing device according to claim 1, wherein the lubricant holding member includes at least one slit formed in the lubricating contact surface between, in the first direction, an outermost one of the recesses in the plurality of recesses and an outer edge of the lubricating contact surface.

6. The fixing device according to claim 1, wherein the heater is a halogen lamp.

7. The fixing device according to claim 1, wherein the lubricant holding member comprises an elastically deformable material that absorbs lubricants.

8. The fixing device according to claim 1, wherein the lubricant holding member comprises at least one of an aramid fiber, a melamine resin, and a glass fiber.

9. The fixing device according to claim 1, wherein the lubricating contact surface has a width in a second direction perpendicular to the first, and each recess of the plurality of recesses extends in the second direction for full width of the lubricating contact surface.

10. The fixing device according to claim 1, wherein the pressing member comprises an elastically deformable portion contacting the inner facing surface of the rotatable heated body at the first position and a base member having a first side attached to the elastically deformable portion.

11. The fixing device according to claim 10, wherein the lubricant holding member is attached a second side of the base member.

12. The fixing device according to claim 1, wherein the heater is a ceramic heater.

13. The fixing device according to claim 1, wherein the spacing between each adjacent pair of recesses in the plurality of recesses is the same.

14. A printing apparatus, comprising:

a fixing belt with a width in a first direction and having an inner facing surface and an outer facing surface;

a heater for heating the fixing belt, the heater having a length dimension in the first direction corresponding to the width of the fixing belt and being in an interior region surrounded by the fixing belt;

a pressing member including an elastically deformable portion, contacting the inner facing surface of the rotatable heated body at a first position, and a base member supporting the elastically deformable portion;

a pressing roller configured to press against the outer facing surface of the rotatable heated body at a position corresponding to the pressing member; and a lubricant holding member with a length dimension in the first direction and a lubricating surface contacting the inner facing surface of the fixing belt at a second position, the lubricant holding member comprising a lubricant retaining material and having a plurality of recesses in the lubricating surface spaced from each other along the length dimension of the lubricant holding member, wherein a first lubricant of a first viscosity is applied to the lubricating contacting surface of the lubricant holding member and a second lubricant of a second viscosity greater than the first viscosity is applied to the plurality of recesses of the lubricant holding member.

15. A fixing device for fixing a toner image to a sheet, the fixing device comprising:

a rotatable heated body with a length dimension in a first direction and having an inner facing surface and an outer facing surface;

a heater for heating the rotatable heated body, the heater having a length dimension in the first direction corresponding to the length dimension of the rotatable heated body;

a pressing member contacting the inner facing surface of the rotatable heated body at a first position;

a pressing roller configured to press against the outer facing surface of the rotatable heated body at a position corresponding to the pressing member; and a lubricant holding member with a length dimension in the first direction and a lubricating surface contacting the inner facing surface of the rotatable heated body at a second position, the lubricant holding member having a plurality of recesses in the lubricating surface spaced from each other along the length dimension of the lubricant holding member, wherein the lubricating holding member has a plurality of slits formed in the lubricating contact surface between adjacent recesses of the plurality of recesses.

16. The fixing device according to claim 15, wherein the slits of the plurality slits extend in a second direction perpendicular to the first direction from an outer edge of the lubricating contact surface for a total distance that is less than a width of the lubricant contacting surface in the second direction.

17. A fixing device for fixing a toner image to a sheet, the fixing device comprising:

a rotatable heated body with a length dimension in a first direction and having an inner facing surface and an outer facing surface;

a heater for heating the rotatable heated body, the heater having a length dimension in the first direction corresponding to the length dimension of the rotatable heated body;

a pressing member contacting the inner facing surface of the rotatable heated body at a first position;

a pressing roller configured to press against the outer facing surface of the rotatable heated body at a position corresponding to the pressing member; and a lubricant holding member with a length dimension in the first direction and a lubricating surface contacting the inner facing surface of the rotatable heated body at a second position, the lubricant holding member having a plurality of recesses in the lubricating surface spaced from each other along the length dimension of the lubricant holding member, wherein the lubricant holding member includes at least one slit formed in the lubricating contact surface between, in the first direction, an outermost one of the recesses in the plurality of recesses and an outer edge of the lubricating contact surface.

18. A fixing device for fixing a toner image to a sheet, the fixing device comprising:

a rotatable heated body with a length dimension in a first direction and having an inner facing surface and an outer facing surface;

a heater for heating the rotatable heated body, the heater having a length dimension in the first direction corresponding to the length dimension of the rotatable heated body;

a pressing member contacting the inner facing surface of the rotatable heated body at a first position;

a pressing roller configured to press against the outer facing surface of the rotatable heated body at a position corresponding to the pressing member; and a lubricant holding member with a length dimension in the first direction and a lubricating surface contacting the inner facing surface of the rotatable heated body at a second position, the lubricant holding member having a plurality of recesses in the lubricating surface spaced from each other along the length dimension of the lubricant holding member, wherein the lubricating contact surface has a width in a second direction perpendicular to the first, and each recess of the plurality of recesses extends in the second direction for full width of the lubricating contact surface.

* * * * *